United States Patent [19]

Greenshields et al.

[11] 3,957,433

[45] May 18, 1976

[54] DYEING ADDITIVES

[75] Inventors: James Nairn Greenshields; George Hull; Bernard Tury, all of Manchester, England

[73] Assignee: Imperial Chemical Industries Limited, London, England

[22] Filed: Apr. 22, 1974

[21] Appl. No.: 463,127

[30] Foreign Application Priority Data

May 14, 1973 United Kingdom..... 22785/73

[52] U.S. Cl...... 8/169; 8/73; 8/172 R; 8/177 AB

[51] Int. Cl.[2]..... D06P 5/04

[58] Field of Search..... 8/169, 172, 73, 177 AB

[56] References Cited

UNITED STATES PATENTS 3,764,262 10/1973 Hildebrand et al..... 8/169 X

*Primary Examiner*—Lewis T. Jacobs

*Attorney, Agent, or Firm*—Cushman, Darby & Cushman

[57] ABSTRACT

Dyeing shaped articles made of polyacrylonitrile, copolymers or blends thereof, with cationic dyestuffs characterised in that the dyeing is carried out in the presence of a quaternary ammonium compound of the formula:

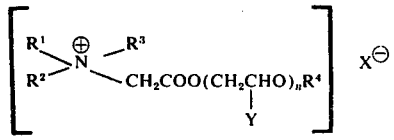

wherein $R^1$, $R^2$ and $R^3$ represent alkyl or alkenyl groups and $R^4$ represents an alkyl group or hydrogen, at least one of said groups $R^1$, $R^2$, $R^3$ and $R^4$ having at least eight and not more than eighteen carbon atoms and the remainder from 1 to 4 carbon atoms, X represents an anion, Y represents hydrogen or methyl and *n* is zero or an average of from 1–30.

6 Claims, No Drawings

DYEING ADDITIVES

This invention relates to the dyeing of materials made of or containing polyacrylonitrile and in particular to the use of certain retarders in such a dyeing process.

Thus according to the present invention there is provided a process for dyeing shaped articles made of polyacrylonitrile, copolymers or blends thereof, with cationic dyestuffs characterised in that the dyeing is carried out in the presence of a quaternary ammonium compound of the formula:

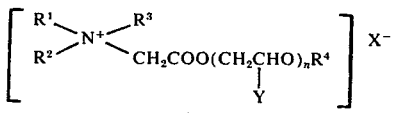

wherein $R^1$, $R^2$ and $R^3$ represent alkyl or alkenyl groups and $R^4$ represents an alkyl group or hydrogen, at least one of said groups $R^1$, $R^2$, $R^3$ and $R^4$ having at least eight carbon atoms and the remainder from 1 to 4 carbon atoms, X represent an anion, Y represents hydrogen or methyl and n is zero or an average of from 1–30.

As examples of alkyl or alkenyl groups having at least eight carbon atoms preferably from 8 to 18 carbon atoms which may be represented by $R^1$, $R^2$, $R^3$ and $R^4$ there may be mentioned the alkyl or alkenyl groups $C_8H_{17}$, $C_{11}H_{23}$, $C_{12}H_{25}$, $C_{16}H_{33}$, $C_{10}H_{21}$, $C_{17}H_{35}$ and $C_{16}H_{31}$. Said groups having at least eight carbon atoms may be mixtures of alkyl, alkenyl or alkyl/alkenyl groups having at least eight carbon atoms.

As examples of alkyl groups having from 1 to 4 carbon atoms which may be represented by $R^1$, $R^2$, $R^3$ and $R^4$ there may be mentioned methyl, ethyl, propyl, isopropyl and the various isomeric butyl radicals.

As examples of the anions represented by X there may be mentioned chloride, bromide, methosulphate and p-toluene sulphonates.

The group $R^4$ may alternatively represent hydrogen.

Thus examples of specific quaternary ammonium compounds useful as retarders in the present invention include the following compounds:

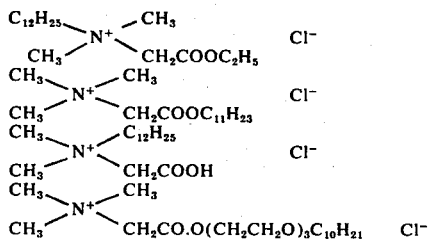

One group of preferred quaternary ammonium compounds is that of the formula:

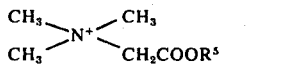

wherein $R^5$ is our alkyl group of from 8 to 18 carbon atoms.

The quaternary ammonium compounds may be obtained by known methods, for example by quaternisation of a tertiary amine of formula $R^1R^2R^3N$, wherein $R^1$, $R^2$ and $R^3$ are as hereinbefore defined, with a chloroacetic ester of formula $ClCH_2COO(CH_2CHYO)_nR^4$, wherein Y, n and $R^4$ are as hereinbefore defined or by reaction with chloroacetic acid. The reaction may be carried out in a solvent for convenience. Elevated temperatures can be used to give faster reaction or more complete reaction. Where the tertiary amine is volatile at the temperature of reaction the reaction may be carried out under pressure.

Shaped articles which may be dyed by the present process include filaments, fibres, films, threads, tapes and textile materials in the form of woven or knitted articles.

The shaped articles may be composed of polyacrylonitrile alone or may be copolymers of acrylonitrile for example with acrylamide, acrylic esters or dicyanoethylene or may be mixtures of individual polymers having a substantial proportion of polyacrylonitrile. They are preferably copolymers or blends containing at least 50% of polyacrylonitrile residues.

Cationic dyes suitable for use in the process of the invention include any of the cationic dyes the use of which in dyeing acrylic fibres is known (viz. dyes often referred to as basic dyes). Such dyes may, for example, be of the diphenylmethane, triphenylmethane or rhodamine types, or they may be azo compounds or anthraquinone compounds as well as thiazine, oxazine, methine and azomethine dyestuffs. Mixtures of two or more such dyes may be used.

The amount of the quaternary ammonium compound or compounds employed in the process of the invention may vary widely according to the extent of the levelling of the dyeing which is required; in any particular case, however, the necessary amount may readily be determined by simple experiment. In the majority of cases, an amount of from 16% to 0.5% and preferably from 8% to 0.5% of the weight of the shaped article being dyed is satisfactory.

The quaternary ammonium compound or compounds may if desired be employed in conjunction with known levelling agents or dyeing assistants.

The conditions employed in carrying out the process may be those which are normally used in the dyeing of acrylic textile materials with cationic dyestuffs. Thus the shaped article may be introduced into an aqueous dyebath which contains the dyestuff or dyestuffs and the quaternary ammonium compound together with acids such as acetic acid and salts such as sodium acetate or sodium sulphate at any temperature in the range 20°C to 100°C., the temperature of the dyebath thereafter being raised to 95°C or to between 100°C and 150°C and held at this temperature for a period of from 15 minutes to 5 hours until exhaustion is achieved. Preferred dyeing conditions are for example a temperature of from 40° to 120°C at a pH of from 3 to 8.

By means of the process of the invention, dyeings of improved levelness of cationic dyestuffs on acrylic textile materials may be achieved.

When conventional non-hydrolysable retarding agents are used in the dyeing of polyacrylonitrile materials, re-dyeing may only be carried out with difficulty.

We have found that the process of the present invention using the quaternary ammonium compound retarders described herein is advantageous in that if the dyeing is not of the required depth of shade, it is possible to repeat the process to re-dye the shaped article to increase the depth of shade. Thus we have found that if the dyed shaped article is given a treatment in an alkaline solution it can then be re-dyed.

Thus as a further feature of the present invention there is provided a process wherein the dyed shaped article is treated in an aqueous alkaline bath and then subjected to a further dyeing treatment. Treatment in an aqueous alkaline bath may be carried out for example for periods of 15 to 60 minutes at a temperature of from 60° to 100°C. A convenient alkaline bath comprises an aqueous solution of from 0.05% to 5% by weight of sodium carbonate. Other alkalies may be used such as ammonia or sodium hydroxide but clearly the alkaline bath must not be so strong as to have a deleterious effect on the shaped article. The aqueous alkaline bath should preferably have a pH of from 8 to 11.

The invention is illustrated by the following examples in which all parts are by weight except where otherwise stated.

EXAMPLE 1

Preparation of trimethyl dodecyloxycarbonylmethyl ammonium chloride

Dodecyl alcohol (372 parts), chloroacetic acid (208 parts) and p-toluene sulphonic acid monohydrate (8 parts) are dissolved in 800 parts by volume of toluene and heated under reflux. The water formed by the esterification reaction is removed from the reflux by a Dean and Stark water separator. After refluxing for 1 hour 40 parts of water are collected. The solution is cooled to room temperature and washed twice with 150 parts by volume of 10% aqueous sodium carbonate followed by two further washings with 150 parts of water. The toluene solution is dried over magnesium sulphate and filtered. Trimethylamine is bubbled through the toluene solution initially at room temperature and the exothermic reaction causes the temperature to rise to 66°C. When no more trimethylamine will absorb the gas flow is stopped and the reaction mixture cooled to room temperature. The white solid product is separated from the toluene by filtration. The filter cake is washed twice with 100 parts by volume of toluene. The white solid is dried to give 619 parts (96% theory) of trimethyl dodecyl oxycarbonylmethyl ammonium chloride.

Dyeing of Acrylic fabric

A polyacrylonitrile fabric is dyed at 95°C for 1 hour at a 25:1 liquor to goods ratio in a dyebath containing 1% acetic acid, 1% sodium acetate, 0.08% yellow dyestuff A and 0.08% of the above product as a retarding agent. After this time the dyestuff is completely exhausted. The fabric is then rinsed and placed in a similar dyebath containing 1% each of acetic acid and sodium acetate and 0.08% blue dyebath B only and further dyed at 95°C for 1 hour. The fabric is then washed and the ratio of yellow to blue colouration is found to be 1:1. A similar dyeing series in the presence of a normal non-hydrolysable retarding agent, of 0.8% butylbenzyl trimethyl ammonium chloride, the colour ratio is 1.4:1.

EXAMPLE 2

In a dyeing sequence similar to that of Example 1 but using 0.08% lauryl dimethyl ethoxycarbonylmethyl ammonium chloride as the retarder a colour ratio of 1.1:1 is found.

EXAMPLE 3

When an acrylic fabric (Orlon 42) (Orlon is a Registered Trade Mark), is dyed with 2% dyestuff A on weight of fibre at 95°C in a dyebath containing 1% each of sodium acetate and acetic acid and 2% on weight of fibre of a normal non-hydrolysable retarding agent, lauryl benzyl trimethylammonium chloride only 55% of the dye is absorbed by the fabric in 1 hour. However if the normal retarding agent is replaced by 2% dodecyloxycarbonylmethyl trimethylammonium chloride a very similar rate of absorption is obtained over the first 30 minutes, but after 1 hour 80% of the dye is absorbed.

EXAMPLE 4

Preparation of agent

The agent is prepared according to the method described in Example 1 replacing the dodecyl alcohol by an ethoxylated mixture of linear $C_{9-11}$ alcohols containing on average 2½ moles ethylene oxide per mole of alcohol.

Dyeing of Acrylic fabric

Dyestuff A dyes a polyacrylonitrile fabric at 1% on weight of fabric at 95°C in a dyebath containing 1% each sodium acetate and acetic acid at such a rate that 25% of the dye is fixed on the fabric after 5 minutes, 50% after 15 minutes and 100% after 90 minutes. When the dyeing is repeated with the dyebath containing additionally 3% on weight of fabric of the above agent the dyeing rates are changed such that 25% of the dye is fixed after 17 minutes, 50% after 40 minutes and 100% after 90 minutes.

EXAMPLE 5

Preparation of agent

A retarding agent is prepared as in Example 1 but replacing dodecyl alcohol by secondary decyl alcohol.

Dyeing of Acrylic fabric

Repeat of the dyeings of Example 4 substituting this retarding agent gives a reduction in initial dyeing rate from 5% of dye/minute to 2% of dye/minute, without affecting the depth of shade after 90 minutes.

EXAMPLE 6

Preparation of agent

A retarding agent is prepared as in Example 1 but replacing dodecyl alcohol by a synthetic linear alcohol of average chain length $C_{14}$.

Dyeing of Acrylic fabric

A polyacrylonitrile fabric is dyed with 0.1% Yellow dyestuff A in the presence of 1.2% of the above agent. The dye is absorbed by the fabric at a constant rate i.e. 40% of the dyestuff is absorbed in 30 minutes, 80% of the dyestuff is absorbed in 60 minutes and the dyeing is complete in 75 minutes. The dyeing is repeated, substituting an equal weight of a non-hydrolysable retarder such as laurylbenzyl trimethylammonium chloride. The rate of dyeing is altered such that 40% of the dye is absorbed in 30 minutes, 60% in 60 minutes and the dyeing is completed in 120 minutes.

EXAMPLE 7

Two similar pieces of acrylic fabric are dyed separately at the boil with 2% of the blue dyestuff B on weight of fabric in dyebaths containing 1% each of sodium acetate and acetic acid to complete dyebath exhaustion. One dyebath (I) contains additionally 2% on the weight of fabric of a normal non-hydrolysable retarding agent (laurylbenzyl trimethylammonium chloride) and the other dyebath (II) contains additionally 2% on weight of fabric of trimethyl tetradecyloxycarbonylmethyl ammonium chloride. After the dyeing the two fabrics are placed in a bath containing 0.1% sodium carbonate and boiled for 30 minutes. The fabrics are then dyed at the boil for 90 minutes in a dyebath containing 1% each of sodium acetate and acetic acid and 5% on weight of fabric of black dyestuff C. The fibre that was originally treated in bath (I) is a grey-black whilst that from bath (II) is intensely black, thus demonstrating that dyeings carried out by the process of the present invention may be over-dyed after an alkaline treatment.

EXAMPLE 8

A polyacrylonitrile fabric is dyed at 95°C for 1 hour at a 25:1 liquor to goods ratio in a dyebath containing 1% sodium acetate, 1% acetic acid, 0.02% yellow dyestuff A and 0.12% trimethyl hexadecyloxycarbonylmethyl ammonium chloride to a pale yellow shade (1). The fabric is boiled in a bath containing 0.5% sodium carbonate for 30 minutes and then dyed at 95°C for 2 hours in a dyebath containing 1% sodium acetate, 1% acetic acid, 0.08% yellow dyestuff A and 0.08% trimethyl hexadecyloxycarbonylmethyl ammonium chloride to a deeper shade (2). The process is repeated substituting a conventional non-hydrolysable retarder, (laurylbenzyl trimethyl ammonium chloride) for the trimethyl tetradecyloxy carbonylmethyl ammonium chloride yielding after the first dyeing a pale shade (3) similar to shade (1) above and after the second dyeing a slightly deeper shade (4) which is much paler than shade (2) above.

Dyestuff A used in the above examples has the formula:

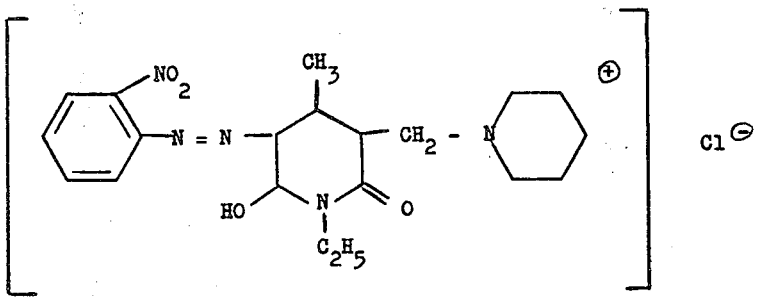

Dyestuff B used in the above examples has the formula:

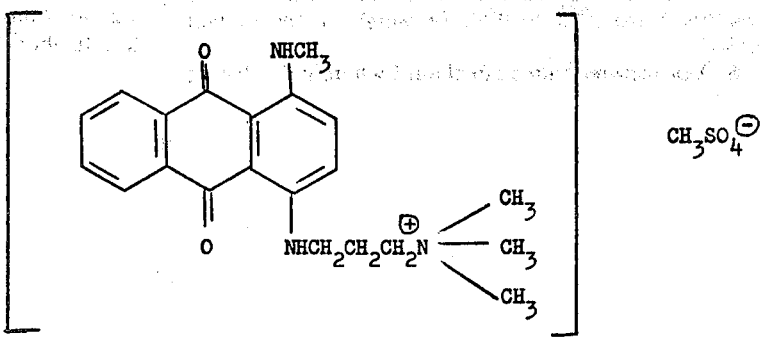

Dyestuff C is a mixture of -

| | |
|---|---|
| a) Malachite Green | 10 parts |
| b) [2-chloro-4-nitro aniline → N-β-(N-ethylanilino) ethyl pyridinium chloride] zinc chloride salt | 77 parts |
| c) 3,7-bis(diethylamino)-phenoxazonium chloride | 13 parts |

We claim:

1. A process for dyeing shaped articles made of polyacrylonitrile, copolymers or blends thereof, with cationic dyestuffs characterised in that the dyeing is carried out in the presence of a quaternary ammonium compound of the formula:

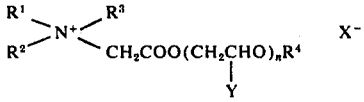

wherein $R^1$, $R^2$ and $R^3$ represent alkyl or alkenyl groups and $R^4$ represents an alkyl group or hydrogen, at least one of said groups $R^1$, $R^2$, $R^3$ and $R^4$ having at least eight and not more than eighteen carbon atoms and the remainder from 1 to 4 carbon atoms, X represents an anion, Y represents hydrogen or methyl and n is zero or an average of from 1–30, wherein the amount of quaternary ammonium compound used is from 16% to 0.5% by weight of the shaped article.

2. A process as claimed in claim 1 wherein the quaternary ammonium compound is of the formula:

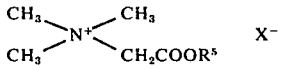

wherein $R^5$ is an alkyl group of from 8 to 18 carbon atoms.

3. A process as claimed in claim 1 wherein the shaped articles contain at least 50% of polyacrylonitrile residues.

4. A process as claimed in claim 1 wherein the amount is from 8% to 0.5% by weight of the shaped article.

5. A process as claimed in claim 1 wherein the dyeing is carried out at a temperature of from 40° to 120°C at a pH of from 3 to 8.

6. A process as claimed in claim 1 wherein the shaped article after dyeing is treated in an aqueous alkaline bath at a pH from 8 to 11 and then subjected to a further dyeing treatment.

* * * * *